US009598951B2

(12) United States Patent
Mueller et al.

(10) Patent No.: US 9,598,951 B2
(45) Date of Patent: Mar. 21, 2017

(54) COUPLED ELECTRONIC AND POWER SUPPLY FRAMES FOR USE WITH BOREHOLE CONDUIT CONNECTIONS

(71) Applicants: Stephan Mueller, Hannover (DE); Ingo Roders, Seelze (DE); Robert Buda, Lower Saxony (DE); Henning Rahn, Celle (DE); Detlev Benedict, Celle (DE); Rene Schulz, Lower Saxony (DE); Volker Peters, Wienhausen (DE)

(72) Inventors: Stephan Mueller, Hannover (DE); Ingo Roders, Seelze (DE); Robert Buda, Lower Saxony (DE); Henning Rahn, Celle (DE); Detlev Benedict, Celle (DE); Rene Schulz, Lower Saxony (DE); Volker Peters, Wienhausen (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 731 days.

(21) Appl. No.: 13/889,815

(22) Filed: May 8, 2013

(65) Prior Publication Data

US 2014/0332235 A1 Nov. 13, 2014

(51) Int. Cl.
*E21B 47/01* (2012.01)
*E21B 17/02* (2006.01)

(52) U.S. Cl.
CPC ..... *E21B 47/011* (2013.01); *E21B 17/028* (2013.01)

(58) Field of Classification Search
CPC ..... E21B 47/011; E21B 17/08; E21B 17/028; E21B 47/01; E21B 47/122; G01V 3/34
See application file for complete search history.

(56) References Cited

U.S. PATENT DOCUMENTS 4,788,544 A * 11/1988 Howard ..... E21B 47/122 324/323
6,392,317 B1 5/2002 Hall et al.
(Continued)

FOREIGN PATENT DOCUMENTS

WO 2012116984 A2 9/2012

OTHER PUBLICATIONS

For the American Heritage Dictionary definition: in. (n.d.) American Heritage® Dictionary of the English Language, Fifth Edition. (2011). Retrieved May 9, 2016 from http://www.thefreedictionary.com/in.*

(Continued)

*Primary Examiner* — Brad Harcourt
*Assistant Examiner* — Wei Wang
(74) *Attorney, Agent, or Firm* — Cantor Colburn LLP

(57) ABSTRACT

An apparatus for retaining electronic components in a downhole component coupling mechanism includes: a power supply frame including a first housing configured to retain a power supply therein and isolate the power supply from downhole fluids, the power supply frame configured to be disposed in and constrained axially by a coupling assembly of a first downhole component and a second downhole component; an electronic component disposed in a second housing in the coupling assembly, the electronic component located external to the power supply frame; and a connector configured to transmit electric power from the power supply to the electronic component to supply electrical power to the electronic component.

20 Claims, 8 Drawing Sheets

(56) References Cited

U.S. PATENT DOCUMENTS

| | | | | |
|---|---|---|---|---|
| 6,727,827 | B1 | 4/2004 | Edwards et al. | |
| 7,098,802 | B2 | 8/2006 | Hall et al. | |
| 7,139,218 | B2 | 11/2006 | Hall et al. | |
| 7,207,396 | B2 | 4/2007 | Hall et al. | |
| 7,224,288 | B2 | 5/2007 | Hall et al. | |
| 7,253,745 | B2 | 8/2007 | Hall et al. | |
| 8,091,627 | B2 | 1/2012 | Hall et al. | |
| 8,242,928 | B2 | 8/2012 | Prammer | |
| 2002/0193004 | A1 | 12/2002 | Boyle | |
| 2005/0056415 | A1* | 3/2005 | Zillinger | E21B 29/02 166/66 |
| 2007/0023185 | A1 | 2/2007 | Hall et al. | |
| 2008/0230232 | A1 | 9/2008 | Farrara | |
| 2009/0014175 | A1 | 1/2009 | Peter | |
| 2009/0058675 | A1 | 3/2009 | Sugiura | |
| 2009/0151926 | A1 | 6/2009 | Hall et al. | |
| 2009/0289808 | A1 | 11/2009 | Prammer | |
| 2010/0071188 | A1* | 3/2010 | Madhavan | E21B 17/02 29/428 |
| 2010/0097890 | A1 | 4/2010 | Sullivan et al. | |
| 2010/0300677 | A1 | 12/2010 | Patterson et al. | |
| 2012/0111555 | A1 | 5/2012 | Leveau et al. | |
| 2012/0125686 | A1 | 5/2012 | Hogseth et al. | |
| 2014/0176334 | A1 | 6/2014 | Benedict et al. | |
| 2015/0060041 | A1 | 3/2015 | Mueller et al. | |

OTHER PUBLICATIONS

For the American Heritage Dictionary definition: at. (n.d.) American Heritage® Dictionary of the English Language, Fifth Edition. (2011). Retrieved May 9, 2016 from http://www.thefreedictionary.com/at.*

Notification of Transmittal of the International Search Report and the Written Opinion of the International Searching Authority, or the Declaration; PCT/US2014/0035619; Mailing date: Aug. 21, 2014, 9 pages.

Wassermann, et al. "How High-Speed Telemetry Affects the Drilling Process", Technology Update, JPT, Jun. 2009. 4 pages.

Notification of Transmittal of the International Search Report and the Written Opinion of the International Searching Authority, or the Declaration; PCT/US2013/074979, Mailed Mar. 26, 2014, 11 pages.

* cited by examiner

COUPLED ELECTRONIC AND POWER SUPPLY FRAMES FOR USE WITH BOREHOLE CONDUIT CONNECTIONS

BACKGROUND

During subterranean drilling and completion operations, various power and/or communication signals may be transmitted through pipe segments or other downhole components, e.g., via a "wired pipe" configuration. Such configurations include electrical, optical or other conductors extending along the length of selected pipe segments. The conductors are operably connected between pipe segments by a variety of coupling configurations.

One such coupling configuration includes a threaded male-female configuration often referred to as a pin box connection. The pin box connection includes a male member, i.e., a "pin" that includes an exterior threaded portion, and a female member, i.e., a "box", that includes an interior threaded portion and is configured to receive the pin in a threaded connection.

Signal repeaters have been used to enhance transmission of power and communications between components over a telemetry line or system. Such repeaters are provided to reduce signal loss during transmission of data from downhole components to the surface.

SUMMARY

An apparatus for retaining electronic components in a downhole component coupling mechanism includes: a power supply frame including a first housing configured to retain a power supply therein and isolate the power supply from downhole fluids, the power supply frame configured to be disposed in and constrained axially by a coupling assembly of a first downhole component and a second downhole component; an electronic component disposed in a second housing in the coupling assembly, the electronic component located external to the power supply frame; and a connector configured to transmit electric power from the power supply to the electronic component to supply electrical power to the electronic component.

A method of coupling downhole components includes: disposing a power supply in a first housing of a power supply frame, the power supply frame configured to isolate the power supply from downhole fluids; disposing the power supply frame in a coupling assembly of a first downhole component and a second downhole component; electrically connecting the power supply to an electronic component disposed in a second housing in the coupling assembly via an electrical connector disposed at the power supply frame, the electronic component configured to facilitate transmission of signals between the first downhole component and the second downhole component; and coupling the first downhole component to the second downhole component and constraining the power supply frame by the coupling assembly, wherein coupling includes communicatively connecting the first downhole component to the second downhole component via the electronic component and the power supply frame.

BRIEF DESCRIPTION OF THE DRAWINGS

The following descriptions should not be considered limiting in any way. With reference to the accompanying drawings, like elements are numbered alike.

DETAILED DESCRIPTION

There is provided an electronic housing assembly for use with downhole components, such as downhole tools, drill pipes and subassemblies. The assembly includes an electronics frame to house electronic components such as repeater electronics within a pressure-sealed and mechanically robust frame that can be mounted at, near or within a coupling configuration (e.g., the pin and/or box portion of a pin-box connector). The assembly also includes an external power supply configured to be disposed at, near or within the coupling configuration. In one embodiment, the external power supply is disposed in a separate frame or housing that is electrically connected to the electronics housing. In one embodiment, a power supply housing is disposed adjacent to the electronics housing within a coupling configuration, e.g., a bore-back section of a pin-box connection. The power supply may be connected to the electronics frame via at least one suitable connection, such as a capacitive, inductive, resonant and/or galvanic connection.

Figure 1:
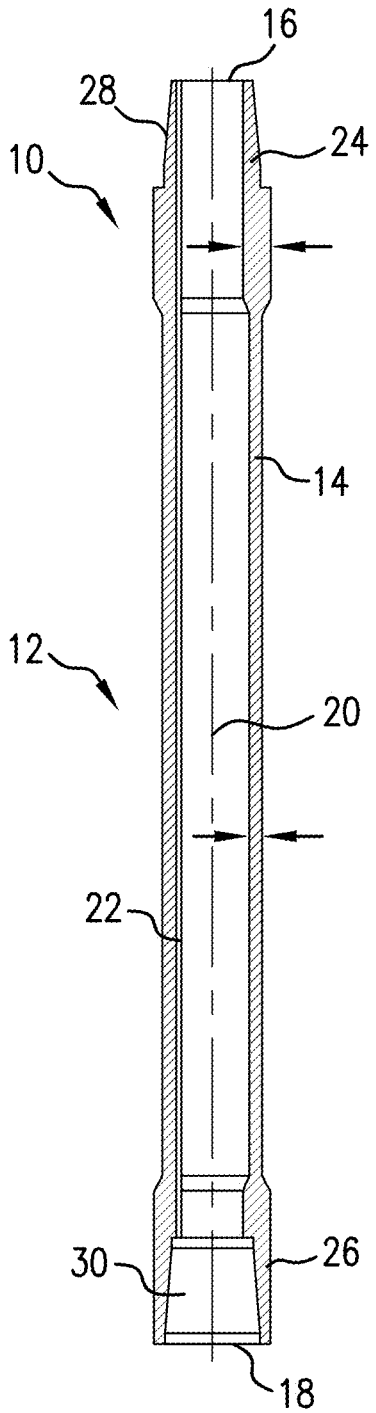
FIG. 1 depicts an embodiment of a conduit segment of a downhole system.

Referring to FIG. 1, an exemplary embodiment of a portion of a well drilling, logging, completion and/or production system 10 includes a conduit or string 12, such as a drillstring or production string, that is configured to be disposed in a borehole for performing operations such as drilling the borehole, making measurements of properties of the borehole and/or the surrounding formation downhole, and facilitating hydrocarbon production.

The string 12 includes at least one string component, such as a pipe segment 14, having a first end 16 and a second end 18. An inner bore or other conduit 20 extends along the length of each segment 14 to allow drilling mud or other fluids to flow therethrough. A communication conduit 22 is located within the segment 14 to provide protection for electrical, optical or other conductors to be disposed along the segment 14. Although the string component is described as a pipe segment, it is not so limited. The string component may be any type of downhole component or carrier that includes a coupling mechanism for coupling the downhole component to another component.

The term "carrier" as used herein means any device, device component, combination of devices, media and/or member that may be used to convey, house, support or otherwise facilitate the use of another device, device component, combination of devices, media and/or member. Exemplary non-limiting carriers include wireline or logging-while-drilling tools, wire pipe, drill strings of the jointed pipe type and any combination or portion thereof. Other carrier examples include casing pipes, wirelines, wireline sondes, slickline sondes, drop shots, downhole subs and BHA's.

The segment 14 includes a coupling assembly having at least one of a first coupling 24 and a second coupling 26. The first coupling 24 includes a male coupling portion 28 having an exterior threaded section, and is referred to herein as a "pin" 24. The second coupling 26 includes a female coupling portion 30 having an interior threaded section, and is referred to herein as a "box" 26.

The pin 24 and the box 26 are configured so that the pin 24 can be disposed within the box 26 to affect a fixed connection therebetween to connect the segment 14 with an adjacent segment 14 or other downhole component. In one embodiment, the exterior of the male coupling portion 28 and the interior of the female coupling portion 30 are tapered along the length of the segment 14 to facilitate coupling. Although the pin 24 and the box 26 are described has having threaded portions, the pin 24 and the box 26 may be configured to be coupled using any suitable mechanism, such as bolts or screws or an interference fit.

FIG. 2 illustrates an embodiment of an electronic housing assembly 40 in various stages of assembly with the coupling assembly. The housing assembly 40 includes a first frame 42 (referred to as an "electronics frame") configured to be disposed within the coupling assembly and configured to hold various electronic components therein. The housing assembly 40 also includes a second frame 44 (referred to as a "power supply frame") configured to hold one or more power supplies, such as batteries. Embodiments of the frames 42 and 44 are described herein, although the frames are not so limited. A "frame" as described herein refers to any housing or structure capable of being disposed with the coupling assembly and capable of retaining components and isolating components from fluid and other environmental conditions.

In the embodiment shown in FIG. 2, the electronics frame 42 and the power supply frame 44 are pressure-sealed and mechanically robust frames configured to be disposed within a coupling assembly between downhole components, e.g., within a space formed within the pin 24 and/or the box 26. In one embodiment, the electronics frame 42 includes electronics configured to facilitate wired pipe telemetry or other communications, and the power supply frame 44 includes a power supply, such as a battery. The frame 42 and/or the frame 44 include components for providing a connection between the power supply and the electronics. The frames 42 and 44 are mechanically distinct and separate from the coupling assembly and the downhole components, and are configured to be secured at least axially based on encapsulation of the frame by the coupling assembly and/or the downhole components. Thus, the housing assembly 40 does not need to be directly sealed or adhered to the connection/components, but rather can rely upon the already existing sealing engagement between the components (e.g., the box-pin connection).

Figure 2A:
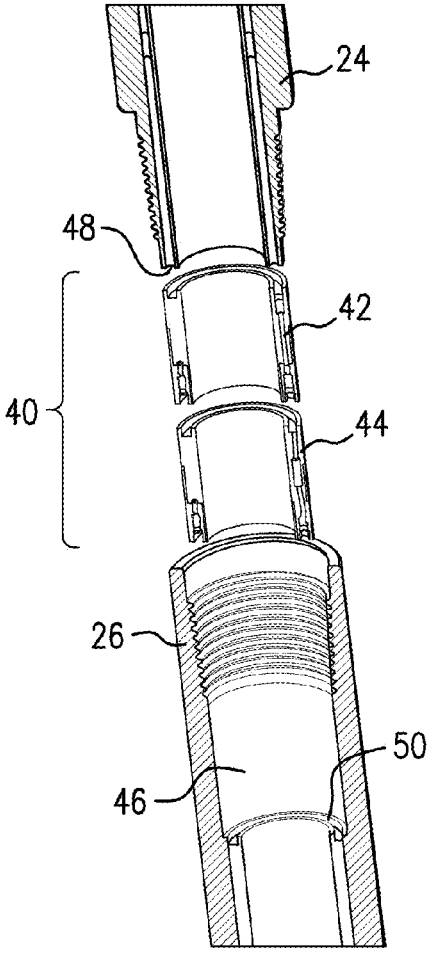
FIGS. 2A-2C (collectively referred to as FIG. 2) depict an exemplary electronic frame assembly disposed in a coupling assembly of a first and second downhole component.
Figure 2B:
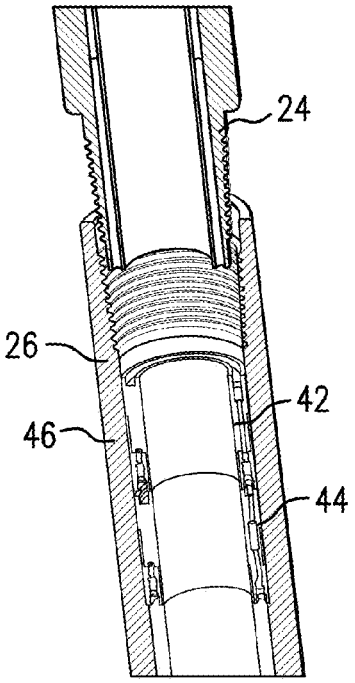

As demonstrated in FIG. 2, in some embodiments, the housing assembly 40 is separate and removable from the coupling mechanism and is shaped or otherwise configured to sit within a portion of the coupling mechanism and held axially in place by the coupling mechanism without requiring any additional connection or securing features. In one embodiment, the coupling mechanism, when assembled, also holds the power supply frame 44 in physical and/or electrical contact with the electronics frame without requiring any additional connection or securing features, such as screws or bonds. FIG. 2A shows the housing assembly 40 prior to assembly. FIG. 2B shows the housing assembly 40 disposed or mounted within an elongated box bore-back 46. The bore-back 46 typically includes a reduction of internal diameter behind the threaded portion of the box 26, and is generally provided to reduce stress concentrations during static and dynamic loading.

In the embodiment of FIG. 2, the electronics frame 42 and the power supply frame 44 are separate structures that can be coupled or connected prior to disposal in the coupling assembly, or connected or coupled during disposal. In one example, the electronics frame 42 is connected or joined to the power supply frame 44 via welding or another permanent joining method, or is removably connected via, e.g., threads or bolts. In one embodiment, the assembled housing assembly 40 is inserted into the bore-back as a single component. In another embodiment, the power supply frame 44 is inserted into the bore-back 46 such that the power supply frame 44 is electrically connected to a cable or other electrical transmission element in the respective pipe segment. The electronics frame 42 is then inserted into the bore-back 46 and electrically connected to the power supply frame 44.

Figure 2C:
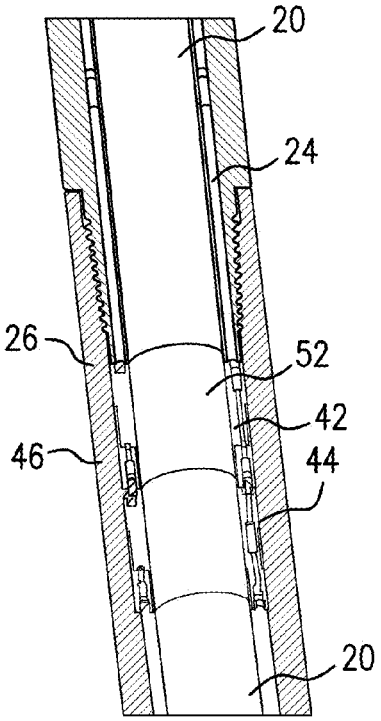

In one embodiment, the housing assembly 40 is not adhered to or rotationally fixed within the bore-back 46, although the housing assembly 40 can be adhered or fixed if desired. FIG. 2C shows the housing assembly 40 within a fully assembled coupling between downhole components (e.g., pipe segments 14). The housing assembly 40 (or at least the outer diameter or surface of the assembly 40) is entirely encapsulated within the string 12 and is held axially in place by, e.g., a pin face 48 and a shoulder 50 formed by the transition between the bore-back 46 and the main inner bore 20 of the string segment 14. The electronics frame 42 and the power supply frame 44 are thus axially secured solely due to the threaded connection and are encapsulated within the connection and tools.

The frames 42 and 44, which in this embodiment are of a generally cylindrical shape (although embodiments are not limited to a particular shape) define a fluid conduit 52, which may be in the form of an inner or central bore, that provides fluid connection between the bores 20 of the string segments 14. The fluid conduit 52, in one embodiment, is a cylindrical central conduit having a diameter that is at least substantially equal to the diameter of the bores 20, although the conduit 52 can have a smaller diameter or have any shape or diameter suitable to transmit fluid between the segments 14. The frames 42 and 44 also include an outer surface (e.g., a cylindrical surface) that is configured to fit within the bore-back 54.

Although the power supply is described in FIG. 2 as being coupled to electronic components disposed in a frame or other structure that is insertable into the coupling assembly, it is not so limited. The power supply may be disposed in any suitable manner such that the electronic components are located external to the power supply frame 44 or other structure supporting or retaining the power supply. For example, the power supply frame 44 is configured to electrically connect to and provide power to electronic components installed in or integrated into one or both pipe segments or the coupling mechanism (e.g., mounted on a pin and/or box surface).

Figure 3:
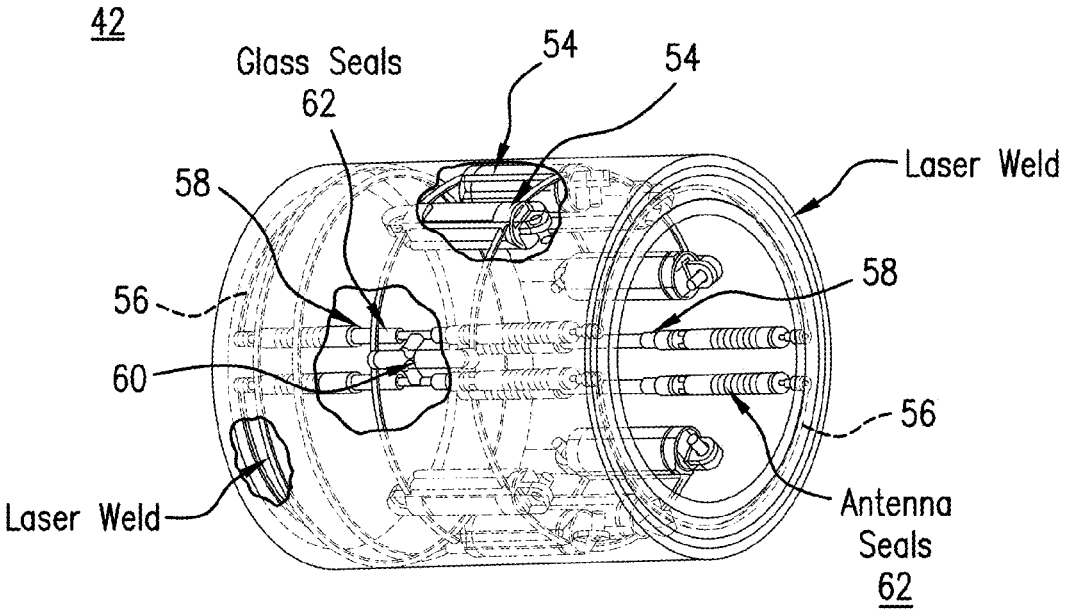
FIG. 3 depicts an embodiment of an electronic frame housing various electronic components.

FIG. 3 illustrates an embodiment of an electronics frame 42. The electronics frame 42 is configured to support electronics for drill pipes, downhole tools and other downhole components. Exemplary electronics include repeater electronics of a signal transmission system configured to transmit power and/or communications between downhole components. For example, the frame 42 includes recesses, chambers or other retaining structures to house repeater components (e.g., electronics and sealing components) for transmitting signals between components. Such exemplary repeater components include control electronics 54 such as multi-chip modules (MCMs), and signal coupling elements 56 such as coupler rings, antennas, electrical contacts and inductive coupling elements. The coupling element may be of any suitable type, such as an inductive coil, direct electrical contacts and an optical connection ring. Other exemplary components include transmission components such as connectors 58, interfaces 60 and various sealing components 62 such as glass seals and antenna seals. Embodiments of the electronics frame are described further in U.S. application Ser. No. 13/724,416, filed on Dec. 21, 2012, the contents of which are incorporated by reference herein in their entirety.

It is noted that the power supply frame 44 may have a similar configuration as that shown in FIG. 3. For example, the power supply frame 44 may include a similar support structure, recesses or pockets for supporting batteries or other power supplies, channels for supporting connectors or conductors, and/or coupling elements to provide an electrical connection between the power supply frame 44 and the electronics frame or a downhole component.

In one embodiment, the electronics frame 42 and/or the power supply frame 44 includes two or more parts or frame elements made from a high strength material (e.g. alloy steel or superalloy), i.e., a material that can withstand temperature, pressure, fluid and operational conditions experienced downhole. The frame elements are joined together to encapsulate the electronic components and/or power supply and isolate the electronic components and/or power supply from borehole fluids and other environmental conditions. As described herein, borehole fluids may include various liquids, gases, mixtures or liquids and gases and flowable solids. Exemplary fluids include water, hydrocarbons, drilling fluids, stimulation fluids, air and other gases, foams, sealing fluids and others.

In one embodiment, the frame elements are mechanically joined together by a permanent mechanical joining, such as a weld or an adhesive. Exemplary welding methods include laser or electron beam welding. As described herein, "permanently joined" is defined as being joined such that the frame elements are mechanically joined via a connection that forms at least a fluid-tight seal between the elements without including a feature (e.g., bolts) that provides a mechanism for disconnecting the elements.

Figure 4:
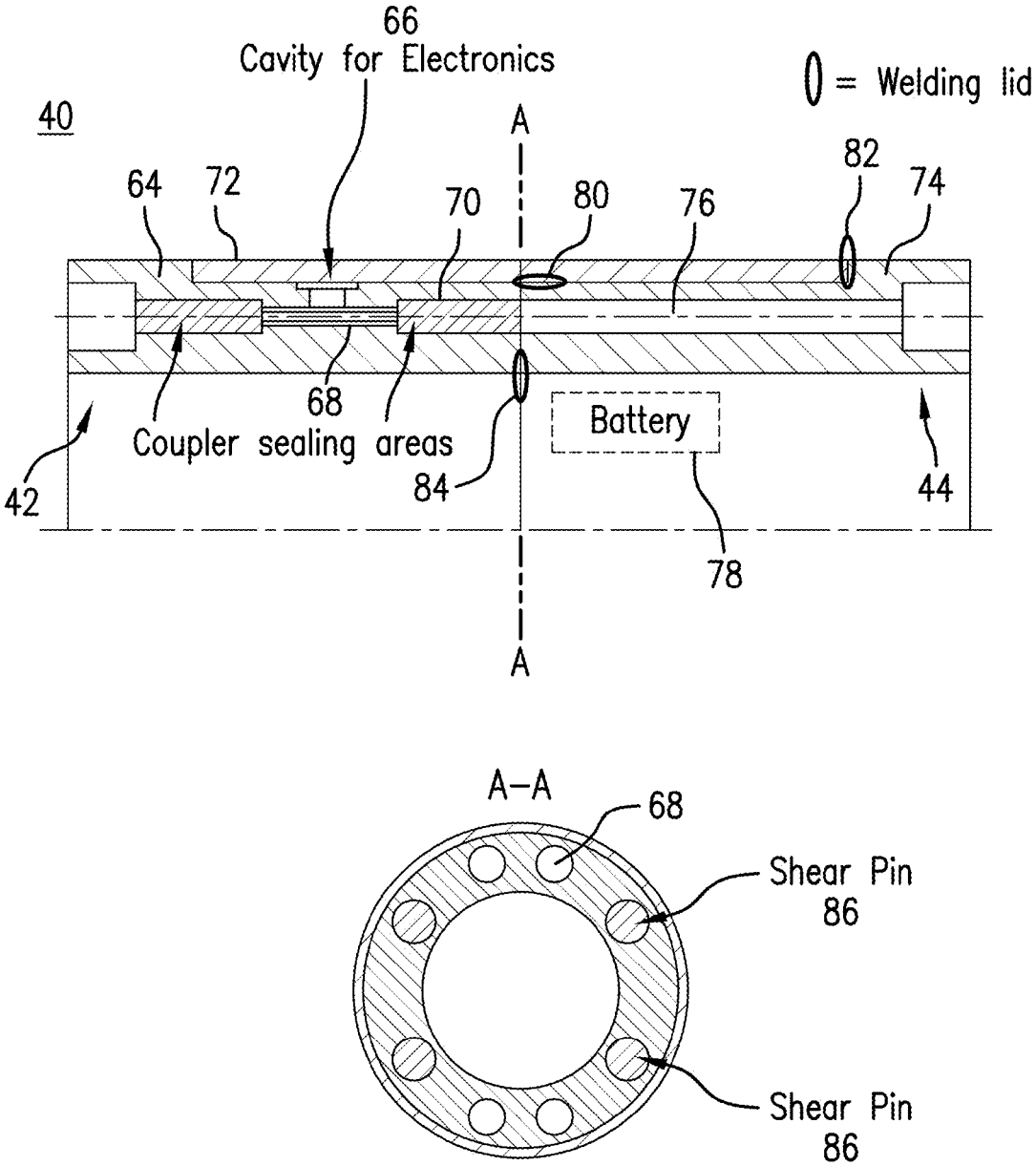
FIG. 4 depicts an embodiment of an electronic housing assembly including an electronics frame and an external power supply.

FIG. 4 illustrates one embodiment of the housing assembly 40 including the electronics frame 42 electrically and mechanically connected to the power supply frame 44. The electronics frame 42 and the power supply frame 44 each include a first or main frame element and one or more second frame elements that are welded or otherwise permanently joined to the main frame element. In this embodiment, the electronics frame 42 includes a first frame element configured as a support structure or main body 64 that includes retaining structures for accommodating various electronic components. Exemplary retaining structures include one or more cavities 66 to accommodate electronic components such as interfaces and processing chips, and bores or channels 68 to accommodate elongated components such as connectors, cables, wires, fluid conduits and optical fibers (e.g., for direct/passive signal transmission and/or active signal transmission). Sealing components such as glass or polymer seals 70 may be included with the channels 68. In the embodiment of FIG. 4, the channels 68 are configured to retain wires or other conduits that are electrically connected to the power supply frame 44 and the drill pipe (e.g., pin or box).

The main body 64 of the electronics frame 42 is joined to a second frame element, which in this embodiment is configured as a sleeve 72 that covers and protects electronic components in, for example, the cavities 66.

The power supply frame 44 includes a support structure or main body 74 that includes one or more channels 76 configured to retain a wire or other conductor to electrically connect the electronics frame 42 to the pipe segment (e.g., pin or box). One or more retaining elements such as one or more pockets 78 are configured to retain a power supply such as a battery. The main body 74 is configured to electrically connect the power supply to the electronics retained in cavity 66. In one embodiment, the power supply and electronics are connected via the channels 68 and 76.

In the embodiment of FIG. 4, the sleeve 72 is a single sleeve joined to both main bodies 64 and 74. In another embodiment, separate sleeves or second frame elements are provided for the electronics frame 42 and the power supply frame 44, or the power supply frame 44 does not include a second frame element. In this embodiment, welds 80 and 82 join the main body 64 and/or the main body 74 to the sleeve 72. For example, as shown in FIG. 4, an end of the sleeve 72 is welded to an annular shoulder of the main body 64, an annular shoulder of the main body 74 and an outer surface of the frame 42 and/or 44.

The electronics frame 42 is connected or coupled to the power supply frame 44, in this embodiment, via a permanent joining technique such as bonding or welding. For example, the frames 42 and 44 are welded via one or more welds 84 that provide a fluid-tight seal between the electronics frame 42 and the power supply frame 44. The mechanisms or features used for connecting or coupling the frames 42 and 44 are not limited to those described herein. For example, the frames 42 and 44 may be connected via a removable connection, such as one or more bolts or screws. In another example, the frames 42 and 44 are held in contact due to the coupling mechanism of the downhole components, such as the pin-box configuration of FIG. 2.

In one embodiment, the second frame element is configured as a portion of the box, pin or other coupling mechanism. For example, instead of the secondary frame element being a sleeve, cover, inlay or other element that is welded to the main body 64 and/or the main body 74 prior to insertion into the pin-box connector, the main body 64 and/or 74 may be welded or joined to a surface in the pin or box. An exemplary surface is a surface of the box bore-back.

In one embodiment, one or more orientation mechanisms are included to ensure that the electronics frame 42 is rotationally oriented relative to the power supply frame 44 so that the proper electrical connection is achieved. For example, as shown in FIG. 4, the frames 42 and 44 include axial bores or channels to accommodate shear pins 86.

In addition to the mechanical connection described above, the electronics frame 42 and the power supply frame 44 are electrically connected via a suitable electrical connection. In the embodiment shown in FIG. 4, the frames 42 and 44 (i.e., conductors disposed in the channel 76 and the channel 68) are connected via galvanic coupling. The connection is not so limited, however, as the connection can be achieved via one or more of capacitive, inductive, resonant or galvanic coupling.

Figure 5:
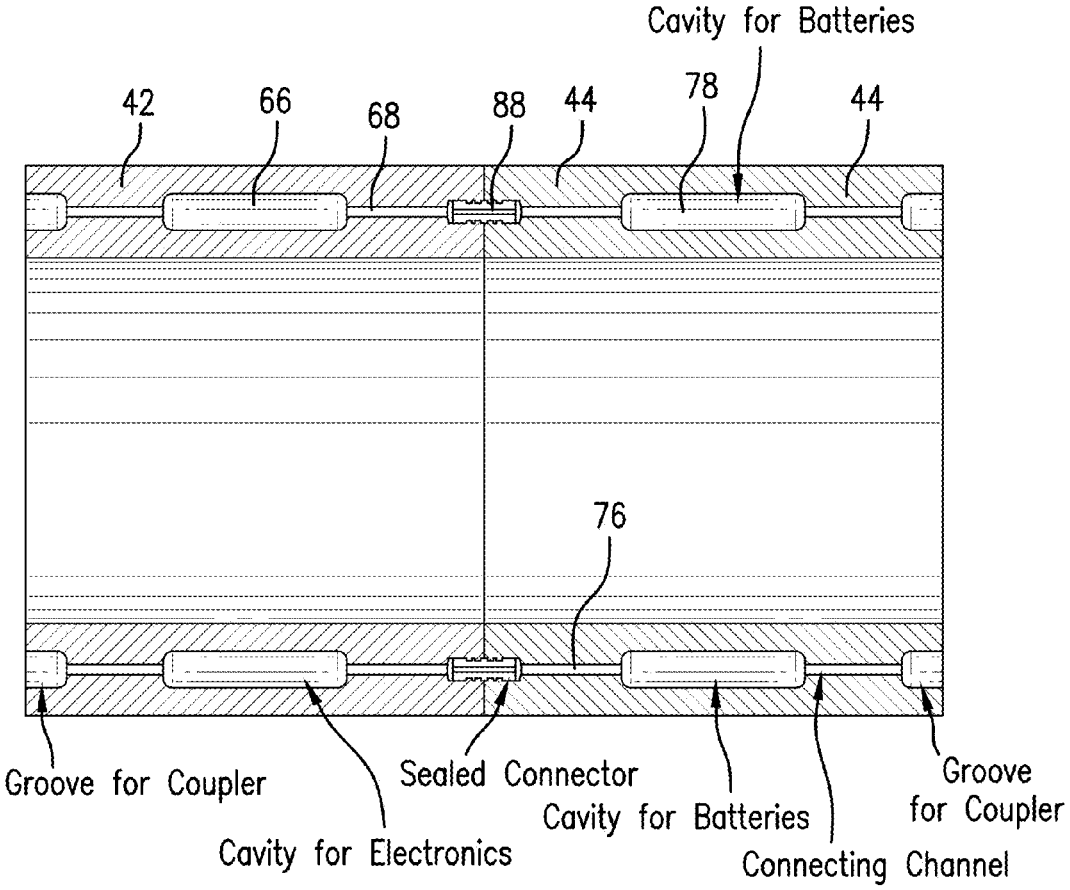
FIG. 5 depicts an embodiment of an electronic housing assembly including an electronics frame and a power supply frame.

FIG. 5 shows an embodiment of a coupling assembly 40 in which the frames 42 are coupled via a sealed connector 88. The connector 88 in this example provides a galvanic coupling. The connector 88 may also include an antenna or coupler ring, which would eliminate the need for rotational orientation to provide an electrical connection. The connector may include other connection mechanisms, such as capacitors, or transmitters and/or receiver coils.

Figure 6:
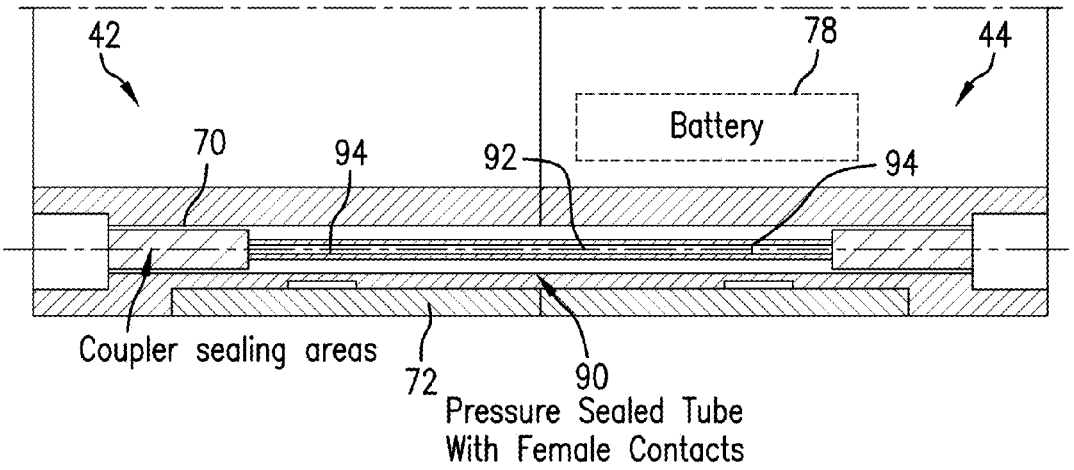
FIG. 6 depicts an embodiment of an electronic housing assembly including an electronics frame and a power supply frame.
Figure 7:
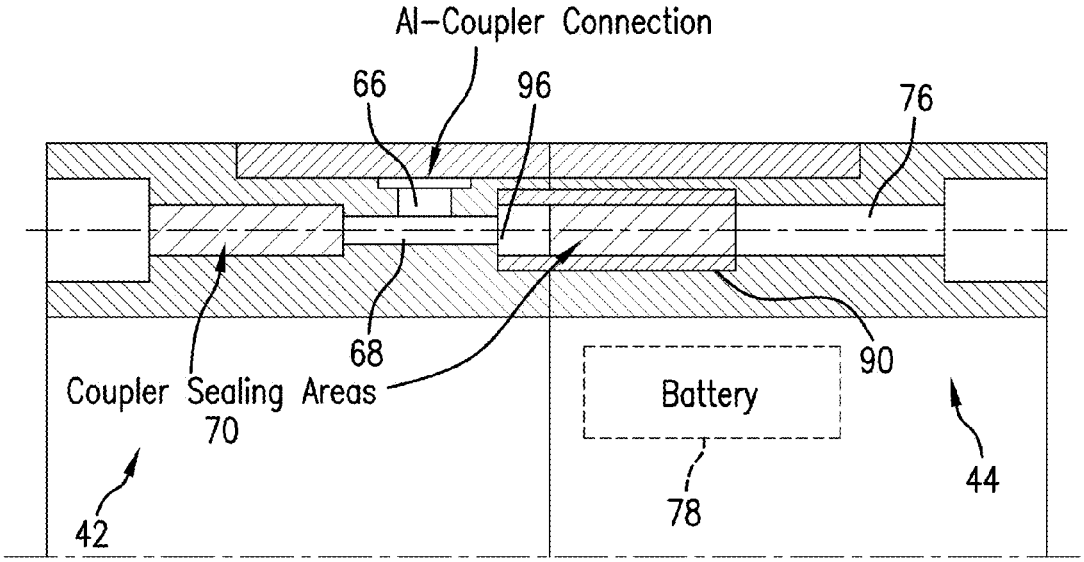
FIG. 7 depicts an embodiment of an electronic housing assembly including an electronics frame and a power supply frame.
Figure 7:
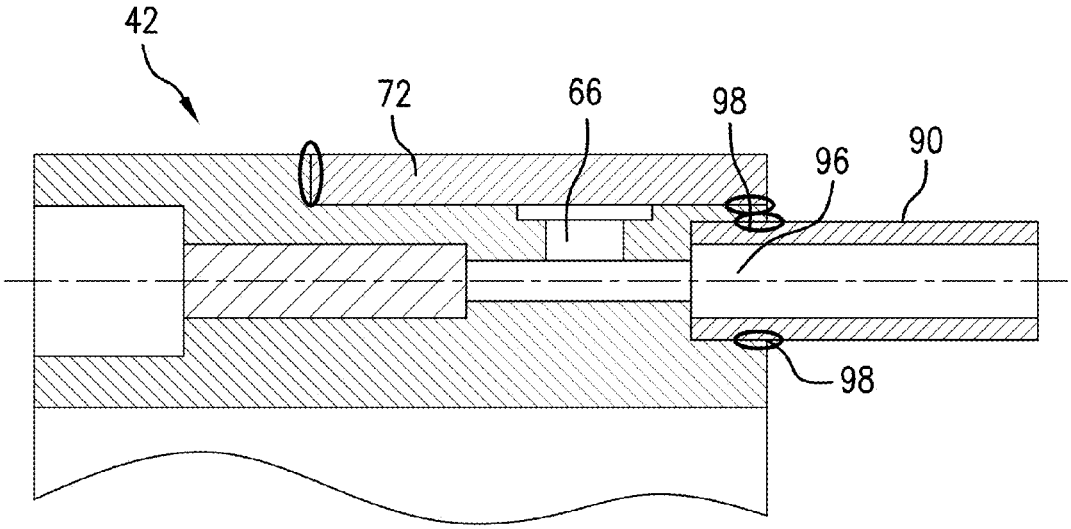

FIGS. 6 and 7 show embodiments having a connection mechanism that includes a sealed connector tube 90. In the embodiment shown in FIG. 6, the connector tube includes a cable segment 92 or other conductor segment configured to connect to conductors disposed within the frames 42 and 44. The conductor segment 92 connects to the frame conductors via female contacts 94, although any type of galvanic contact could be used.

FIG. 7 shows an embodiment in which the connector tube 90 is disposed around the channel 76 in the power supply frame 44. The tube 90 extends beyond the end of the power supply frame 44 and is configured to couple with an enlarged coupling portion 96 of the electronics frame 42. In one embodiment, the tube 90 is incorporated into the electronics frame 42 and is configured to be inserted into an enlarged channel portion in the power supply frame 44. In one embodiment, both the frames 42 and 44 include an enlarged portion so that the tube 90 can be inserted into both frames. The tube 90 may be joined to the frame 42 via welds 98 or other joining mechanisms. The tube 90 as shown in FIGS. 6 and 7 may also be used to orient the frames 42 and 44 relative to each other.

In one embodiment, the frame 42 and/or the frame 44 includes fixation elements configured to hold the housing assembly 44 in a fixed position, e.g., a fixed rotational position, relative to the pipe segment(s) 14. For example, grooves or recesses may be included in one of the housing assembly 44 and the pipe segment (e.g., the box bore-back interior surface) that are configured to engage corresponding protrusions in the other of the housing assembly 44 and the pipe segment. Other fixation element embodiments may include bolts, screws and other forms of fit elements. Any type of fixation element or mechanism may be used, including interference fit configurations, gluing, welding and bonding. As discussed above, the tube 90 or other type of electrical connection may be used as a fixation element.

Figure 8:
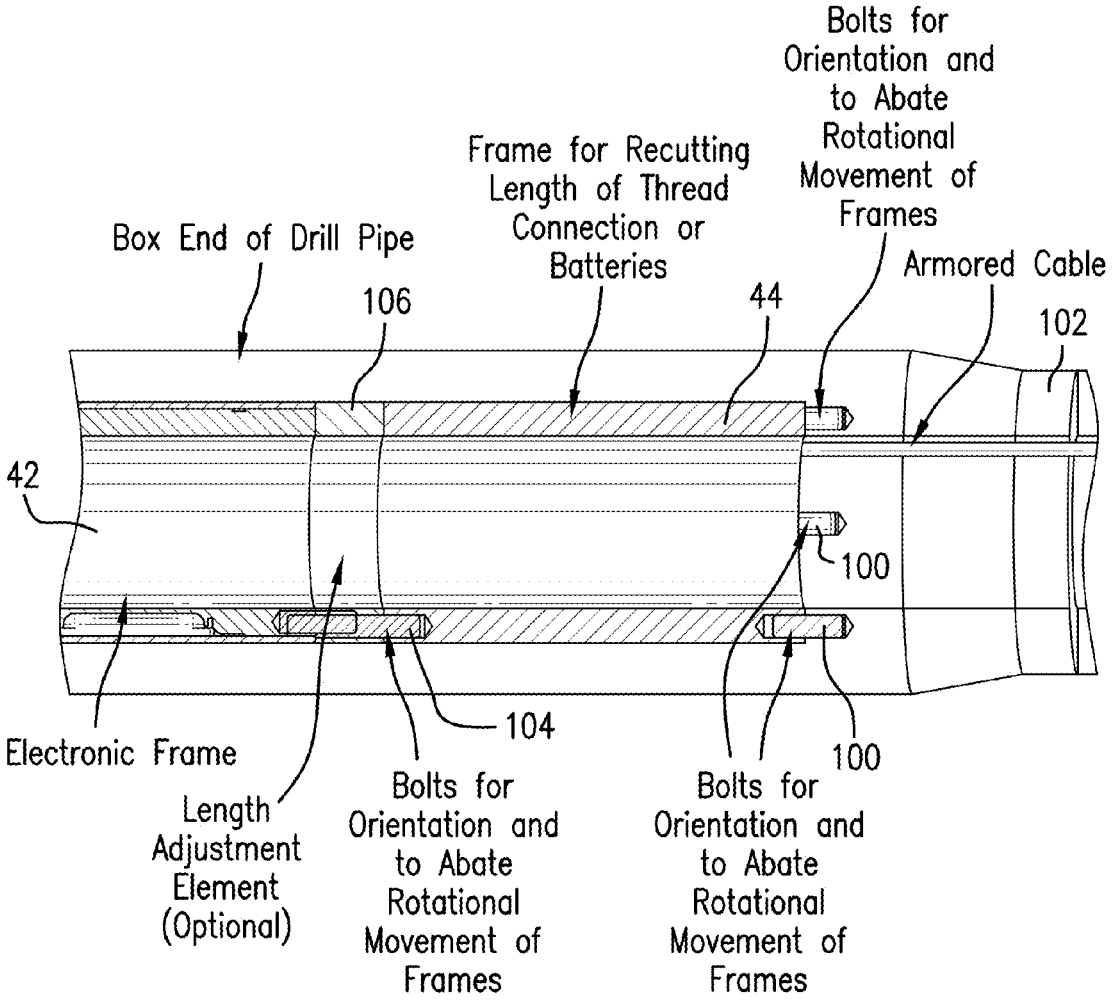
FIG. 8 depicts an embodiment of an electronic housing assembly including an electronics frame and a power supply frame disposed in a downhole component coupling assembly.

FIG. 8 shows an example of such fixation elements. One or more plugs or bolts 100 are configured to rotationally secure the power supply frame 44 to a pipe segment 102. The frame 44 in this example is a cylindrical frame disposed in a box bore back of the pipe segment 102. Bolts 100 may be separate components as shown and insertable into holes formed in the pipe segment and/or the power supply frame 44, but are not so limited. In some examples, the bolts 100 may be attached to or integral with the power supply frame 44 such that the bolts can be inserted into holes of the pipe segment when the frame 44 is inserted into the bore back. Other fixation elements include one or more plugs or bolts 104 that can engage the frames 42 and 44 to prevent relative rotation and provide orientation.

In one embodiment, a length adjustment element is included to conform the assembly 40 the bore back or other portion of the pipe segment. For example, the length adjustment element is a cylindrical element such as a gasket 106 having an axial length that results in a desired length of the housing assembly 40. The adjustment element may have a fixed length or may be adjustable to change the length of the assembly 40 as desired.

Figure 9:
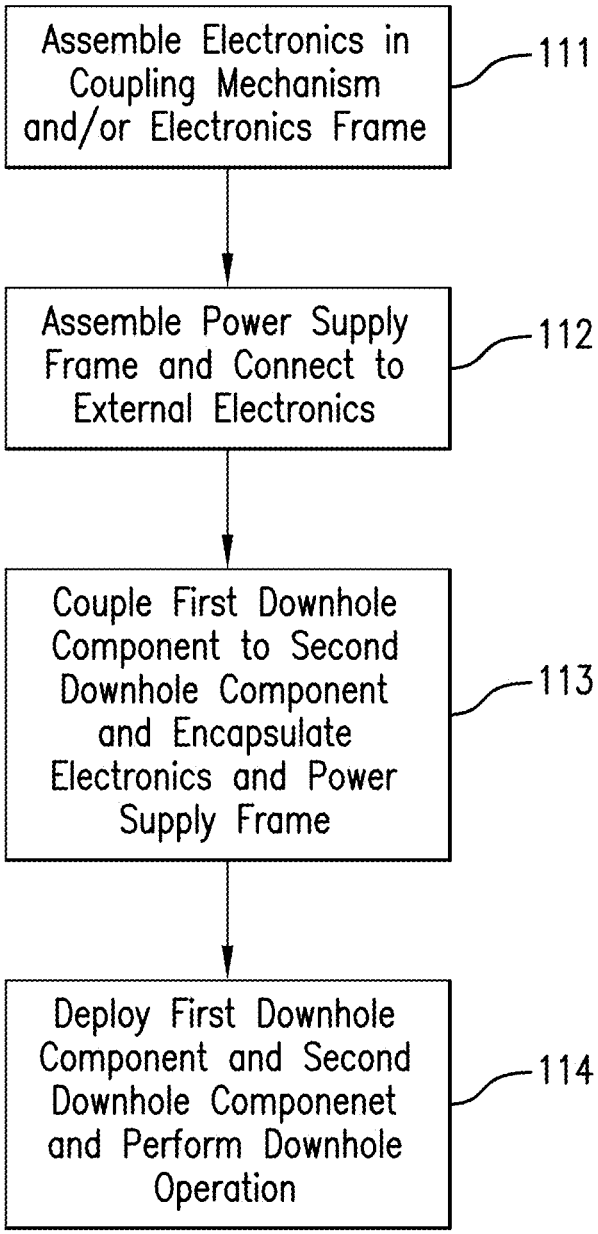
FIG. 9 depicts a flow chart providing an exemplary method of manufacturing an electronic housing assembly, coupling segments of a borehole conduit and/or performing a downhole operation.

One embodiment of a method 110 of manufacturing an electronic housing assembly, coupling downhole components and/or performing a downhole operation is shown in FIG. 9. The method 110 includes one or more stages 111-114. In one embodiment, the method 100 includes the execution of all of stages 111-114 in the order described. However, certain stages may be omitted, stages may be added, or the order of the stages changed.

In the first stage 111, electronics are disposed or assembled in a coupling mechanism. The electronics may be attached or mounted directly to the coupling mechanism or may be disposed in a retaining structure such as the electronics frame 42.

In the second stage 112, a power supply is disposed in a retaining structure such as the power supply frame 44 and electrically connected to the electronics. An exemplary power supply retaining structure includes a main body having recesses or pockets to retain the power supply (e.g., a battery), and the power supply retaining structure is assembled by welding or otherwise joining a sleeve or other protective structure to the main body to isolate the power supply.

In the third stage 113, a first downhole component is coupled to a second downhole component. As described above, in one example, the electronics frame 42 and/or the power supply frame 44 are inserted into the box bore-back 46, and the pin and box are assembled to encapsulate and axially restrict the electronics frame 42 and/or the power supply frame 44. In other embodiments, the power supply frame 44 is inserted into the coupling assembly and electrically connected to electronics incorporated into the coupling assembly and/or one or more downhole components.

The coupling assembly is assembled around the electronics frame 42 and/or the power supply frame 44 to constrain the frame 42 and/or frame 44 therein. The coupling assembly may hold the electronics frame 42 and the power supply frame 42 in physical or mechanical contact, and may also hold the frames in electrical contact. For example, the pin end of a first component is inserted into the box end of a second component, and the pin is rotated to engage the threaded portion of the box. As shown in the example of FIG. 2, the power supply frame 44 is thus entirely constrained within the pin-box coupling and the connected borehole string. It is noted that the electronics frame 42 and/or the power supply frame 44 need not be rotated or angularly positioned (e.g., when an antenna or coupler ring is used, and are not necessarily restricted in the angular direction.

In the fourth stage 114, the first and second downhole components (e.g., segments 14) are lowered into a borehole. The segments 14 may be lowered into the borehole during or after a drilling, completion, measurement or other downhole operation. Additional segments 14 may be connected together via, e.g., respective pins 24 and boxes 26 including a frame 40 to further lengthen the string and lower the string 12 into the borehole.

The apparatuses and methods described herein provide various advantages over existing methods and devices. For example, the frames provide highly reliable housing and sealing of electronic and power supply components under high mud pressure (e.g. 30000 psi) in an inner bore as well as in the annulus and on the outer diameter of downhole equipment.

Connection between downhole components can be relatively easily achieved, as the frame(s) can be easily mounted, axially fixed and dismounted within the bore-back or other portion of a coupling assembly. In addition, assembly of the frame(s) within the coupling assembly, in some embodiments, does not require angular positioning. Furthermore, the power supply frame can be easily mounted within a coupling mechanism to provide an easy exchangeable energy source.

In support of the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for retaining electronic components in a downhole component coupling mechanism, comprising:

a power supply frame including a first housing configured to retain a power supply therein and isolate the power supply from downhole fluids, the power supply frame configured to be disposed in a coupling assembly including a first coupling portion of a first downhole component and a second coupling portion of a second downhole component, the first coupling portion configured to engage the second coupling portion to connect the first downhole component to the second downhole component, the power supply frame being seprate from the first downhole component, the second downhole component and the coupling assembly, the power supply frame configured to be at least partially disposed in a space formed by at least the second coupling portion and constrained axially by the first coupling portion without any additional securing features upon engagement of the first coupling portion with the second coupling portion;

an electronic component disposed in a second housing in the coupling assembly, the electronic component located external to the power supply frame; and a connector configured to transmit electric power from the power supply to the electronic component to supply electrical power to the electronic component.

2. The apparatus of claim 1, wherein the electronic component is configured to facilitate transmission of signals between the first downhole component and the second downhole component.

3. The apparatus of claim 1, wherein the second housing is incorporated in an electronics frame configured to retain the electronic component therein and isolate the electronic component from downhole fluids, the electronics frame configured to be disposed in the coupling assembly and constrained axially by the power supply frame and the coupling assembly.

4. The apparatus of claim 1, wherein the second housing is attached to the coupling assembly.

5. The apparatus of claim 1, wherein the power supply frame includes a retaining structure configured to retain the power supply, and a protective structure configured to be disposed at the retaining structure, the protective structure permanently joined to the retaining structure to isolate the power supply from downhole fluids and form the power supply frame.

6. The apparatus of claim 1, further comprising a fluid conduit formed by at least the power supply frame, the fluid conduit configured to provide fluid communication through the coupling assembly and between the first and second downhole component.

7. The apparatus of claim 1, wherein the coupling assembly includes a pin located at an end of the first downhole component and a box at an end of the second downhole component, and the power supply frame is configured to be disposed in a bore-back region of the box and constrained axially by the pin and the box when the coupling mechanism is assembled.

8. The apparatus of claim 1, wherein the connector is a galvanic connector.

9. The apparatus of claim 8, wherein the connector is disposed in a sealed tube configured to connect a conductor in the power supply frame to the electronic component.

10. The apparatus of claim 1, wherein the connector is selected from at least one of a capacitive connector, an inductive connector and a resonant connector.

11. The apparatus of claim 1, wherein the electronic component is disposed in an electronics frame separate from the power supply frame, the electronics frame electrically connected to the power supply frame, the electronics frame and the power supply frame held in contact by the first downhole component and the second downhole component when the coupling assembly is assembled.

12. A method of coupling downhole components comprising:

disposing a power supply in a first housing of a power supply frame, the power supply frame configured to isolate the power supply from downhole fluids;

disposing the power supply frame and a second housing in a coupling assembly of a first downhole component and a second downhole component the coupling assembly including a first coupling portion of a first downhole component and a second coupling portion of a second downhole component, the power supply frame being separate from the first downhole component, the second downhole component and the coupling assembly, wherein disposing the power supply frame includes at least partially inserting the power supply frame into a space formed by at least the second coupling portion;

electrically connecting the power supply to an electronic component disposed in the coupling assembly via an electrical connector disposed at the power supply frame, the electronic component configured to facilitate transmission of signals between the first downhole component and the second downhole component; and coupling the first downhole component to the second downhole component and constraining the power supply frame by the coupling assembly, wherein coupling includes engaging the first coupling portion with the second coupling portion, communicatively connecting the first downhole component to the second downhole component via the electronic component and the power supply frame, and axially constraining at least the power supply frame by first coupling portion without any additional securing features.

13. The method of claim 12, further comprising disposing the first downhole component and the second downhole component in a borehole in an earth formation and performing a downhole operation, the downhole operation including advancing a borehole fluid between the first downhole component and the second downhole component through a fluid conduit formed by at the power supply frame.

14. The method of claim 12, wherein the second housing is incorporated in an electronics frame, the second housing separate from the first housing, the electronics frame configured to isolate the electronic component from downhole fluids.

15. The method of claim 14, wherein disposing the power supply frame includes electrically connecting the power supply frame to the electronics frame and disposing both the electronics frame and the power supply frame in the coupling assembly, wherein coupling the first downhole component to the second downhole component axially constrains both the electronics frame and the power supply frame.

16. The method of claim 12, wherein disposing the power supply in the first housing includes inserting the power supply into a recess formed in the first housing, and permanently joining a protective structure to the first housing to isolate the power supply from downhole fluids and form the power supply frame.

17. The method of claim 12, wherein the coupling assembly includes a pin located at an end of the first downhole component and a box at an end of the second downhole component.

18. The method of claim 17, wherein the power supply frame is configured to be disposed in a bore-back region of the box and constrained axially by the pin and the box when the coupling mechanism is assembled.

19. The method of claim 18, wherein the electrical connector is a galvanic connector.

20. The method of claim 19, wherein the electrical connector is disposed in a sealed tube configured to connect a conductor in the power supply frame to the electronic component.

* * * * *